US007546972B2

(12) United States Patent
Heitze et al.

(10) Patent No.: US 7,546,972 B2
(45) Date of Patent: Jun. 16, 2009

(54) COILER DEVICE FOR ROLLED STRIP

(75) Inventors: Gerhard Heitze, Netphen (DE); Klaus Bäumer, Kreuztal (DE)

(73) Assignee: SMS Demag AG, Düsseldorf (DE)

( * ) Notice: Subject to any disclaimer, the term of this patent is extended or adjusted under 35 U.S.C. 154(b) by 233 days.

(21) Appl. No.: 10/538,971

(22) PCT Filed: Dec. 10, 2003

(86) PCT No.: PCT/EP03/14002

§ 371 (c)(1),
(2), (4) Date: Jun. 14, 2005

(87) PCT Pub. No.: WO2004/054731

PCT Pub. Date: Jul. 1, 2004

(65) Prior Publication Data

US 2006/0163414 A1 Jul. 27, 2006

(30) Foreign Application Priority Data

Dec. 14, 2002 (DE) ..... 102 58 539

(51) Int. Cl.
*B65H 18/26* (2006.01)

(52) U.S. Cl. ..... 242/542.4

(58) Field of Classification Search ..... 242/542, 242/542.4, 541.4, 541.6, 541.7, 610.6; 492/56
See application file for complete search history.

(56) References Cited

U.S. PATENT DOCUMENTS

| | | | | |
|---|---|---|---|---|
| 2,928,621 | A * | 3/1960 | Cohn | 242/573.5 |
| 2,985,398 | A * | 5/1961 | Rockstrom et al. | 242/530.4 |
| 4,541,585 | A * | 9/1985 | Frye et al. | 242/542.4 |
| 5,223,072 | A * | 6/1993 | Brockman et al. | 242/420.6 |
| 5,803,399 | A | 9/1998 | Hashikawa | |
| 6,056,230 | A * | 5/2000 | Peters et al. | 242/541.5 |
| 2004/0075012 | A1 * | 4/2004 | Yermal et al. | 242/530.1 |

FOREIGN PATENT DOCUMENTS

| | | |
|---|---|---|
| DE | 2 412 747 | 12/1974 |
| DE | 198 03 091 | 7/1999 |
| EP | 0 741 253 | 11/1996 |

OTHER PUBLICATIONS

Patent Abstracts of Japan, vol. 1999, No. 04, Apr. 30, 1999 & JP 11 005118 A (Kawasaki Steel Corp), Jan. 12, 1999.

* cited by examiner

*Primary Examiner*—Peter M Cuomo
*Assistant Examiner*—William E Dondero
(74) *Attorney, Agent, or Firm*—Friedrich Kueffner

(57) ABSTRACT

The invention relates to a coiler device for a rolled strip comprising at least one driven troughed roller (1) for rotating a coil (2) during the coiling and uncoiling of a rolled strip, in addition to a roller line located upstream or downstream of the coil. According to the invention, the troughed roller (1) is configured with an elastically deformable outer collar (4).

12 Claims, 2 Drawing Sheets

COILER DEVICE FOR ROLLED STRIP

Figure 1:
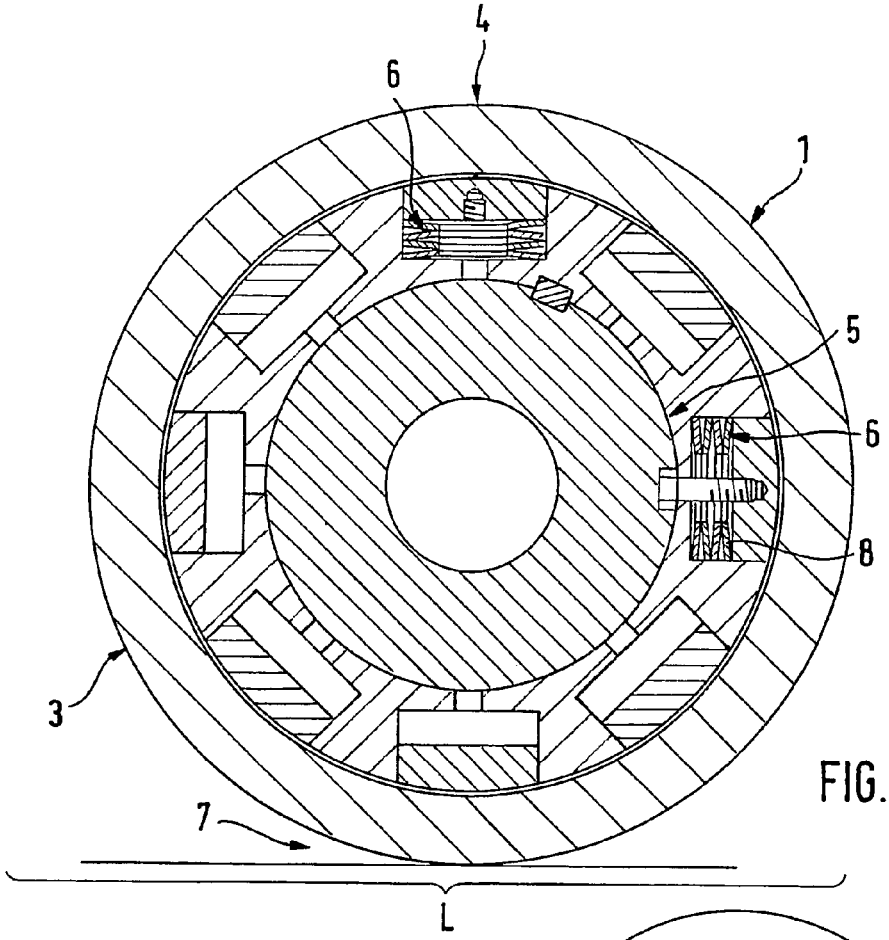

The invention concerns a coiler for rolled strip, which comprises at least one driven troughed roller for turning a coil during coiling or uncoiling of a rolled strip and a roller table upstream or downstream of the coiler.

Coilers with troughed rollers are generally used in the exit section of a hot wide strip or in hot strip conveyance. The function of the troughed roller is to turn the coil with its drive and to drive the rolled strip to a shear, which is arranged perpendicularly next to the coil conveyance system. The coil is cropped at the shear, and samples are cut from the rolled strip.

Prior-art troughed rollers are designed with fixed diametral dimensions and are designed for an approximate radius adaptation with a concave contact surface for the coil. During the turning of cambered coils, this leads to marks on the circumference of the coil due to line contact rolling effects. The previously known designs of troughed rollers are also very stiff due to their dimensions and do not allow flexure of the roller.

Document DE-OS 24 127 47 describes a withdrawing and straightening installation for coils of hot-rolled sheet with a pair of bearing rollers for the sheet coils and a holding device for the end of the sheet, with which the sheet can be withdrawn by a reverse-bending roller.

The two bearing rollers and a lifting table arranged between them are mounted on a movable coil car. The coil car can be coupled with a withdrawal car that can be displaced relative to the stationary holding device. The withdrawal car carries an additional driven bearing roller, which, together with the bearing rollers of the coil car that are closer to it, forms another pair of bearing rollers. A support roll whose position can be adjusted is provided on each of the two cars before or after the bearing rollers, and the support roll supported on the withdrawal car also serves as a reverse-bending roller.

The document DE 197 45 653 A1 describes an uncoiling device for uncoiling a strip that has been wound into a coil, with a pay-off reel and a roller table downstream of the pay-off reel, such that the roller table has a base frame with a lower driving and bending roll and an upper frame with an upper driving roll with an upper driving axle and an upper bending roll. On its side facing the uncoiler, the upper frame has a coil opener for opening the coil, such that the upper frame can be moved towards the uncoiler.

In addition, the coil opener can be rotated about an axis of rotation between an operating position and an idle position.

The document DE 198 03 091 A1 discloses an operating method for a strip transfer installation with a coiling station with one take-up reel each on the inlet side and the outlet side and an uncoiling station with one pay-off reel each on the inlet side and the outlet side, such that a strip is coiled into a coil in the coiling station, or a coil is placed on the take-up reels, and such that the coil is supported by the take-up reels during the coiling or after placement. For uncoiling, the coil is transferred to the uncoiling station, and after the transfer, the coil is supported by the pay-off reels during uncoiling. To transfer the coil, the coiling stations are moved towards each other, and the take-up reel on the inlet side is lifted.

The strip transfer installation provided according to the operating method, with a coiling station and with one take-up reel each on the inlet side and the outlet side and with an uncoiling station with one pay-off reel each on the inlet side and the outlet side, is designed in such a way that the coiling stations can be moved towards each other, and that the take-up reel on the inlet side can be lifted.

The document DE 30 31 825 C2 describes a device for transferring hot metal strip that has been roughed down and wound into coils from a coiling station assigned to a roughing train to an uncoiling station assigned to a finishing train. The transfer device consists of a vehicle, which can be moved on a track transversely to the direction of movement of the strip and which, in the operating position, has an approximately vertical arm with a laterally projecting support surface for the coil. The arm is part of an upper section mounted on a base frame. To allow the coil to be picked up and set down, the line is movable. The track for the vehicle is laid below the floor level of the rolling mill. The upper part of the vehicle consists of toggle joints and in its collapsed state can be moved through below the uncoiling station of the finishing train.

Proceeding on the basis of the aforementioned prior art, the objective of the invention is to specify a new design solution for the design of the troughed roller of a coiler, so that the coiler can better adapt to a cambered coil and provides good support over the width of the coil, so that marks can be reliably avoided, especially in the case of thin strip.

In accordance with the invention, this objective is achieved in a coiler with at least one driven troughed roller in accordance with the introductory clause of claim 1 by the measure of designing the troughed roller with an elastically deformable outer collar.

As a further refinement of the troughed roller, it is proposed that the working surface of the troughed roller be formed by a series of adjoining outer collars of different diameters, which surround a core of the troughed roller and are uniformly supported in such a way by means of support elements that are spring-tensioned from the inside against the outer collars that they act on the contact surface of the troughed roller with the coil over its entire longitudinal extent with uniform contact pressure.

In another design of the coiler of the invention with a troughed roller, the support members are designed with curved contact surfaces to adapt them to the inner circumference of the outer collars.

In addition, the invention provides that the back of each support member is lined with a set of disk springs with predeterminable pretensioning. In this regard, it can be provided that the support members are mounted in the outer collars with pretensionable spring force.

To create smooth transitions of the outer collars, the invention further provides that adjoining outer collars fit next to the adjacent outer collars with an oblique transition, i.e., they "phase in" to each other, especially in the case of outer collars with different diameters.

In accordance with another embodiment of the troughed roller, the bearing surfaces of the outer collars can be designed with a slight camber, which, however, does not exceed the magnitude of the difference in diameters.

The coiler is further developed in such a way that two troughed rollers that can be arranged with a predeterminable axially parallel separation act together to form a trough-like depression between the troughed rollers for supporting the cylindrical load of the coil. At least one of these troughed rollers is equipped with a rotational drive. It is advantageous for the troughed roller to comprise a solid central shaft, a middle collar on the shaft for holding support members that can be spring-tensioned, and an outer collar with an outer support collar for supporting the load in the form of a coil.

Finally, the troughed roller of the coiler has a contact surface that forms on a coil during the uncoiling, especially a concave contact surface, which can be automatically adapted to the usually cambered circumference of the coil by means of the outer collars that yield in an elastically yielding way.

Additional details, features and advantages of the invention are disclosed in the following explanation of the specific embodiment of the invention which is schematically illustrated in the drawings.

FIG. 1 shows a sectional view of the troughed roller in a plane perpendicular to the axis of rotation.

Figure 1B:
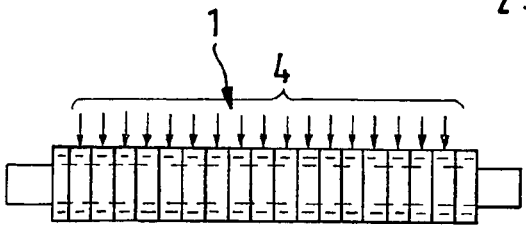
Figure 1A:
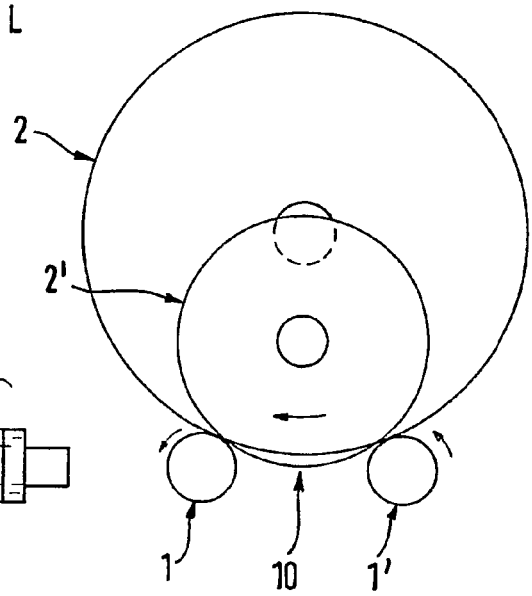

FIG. 1*a* shows a front view of two spaced troughed rollers holding a load in the form of two unequally large coils.

FIG. 1*b* shows a side view of the troughed roller with the effect of the load indicated.

Figure 2:
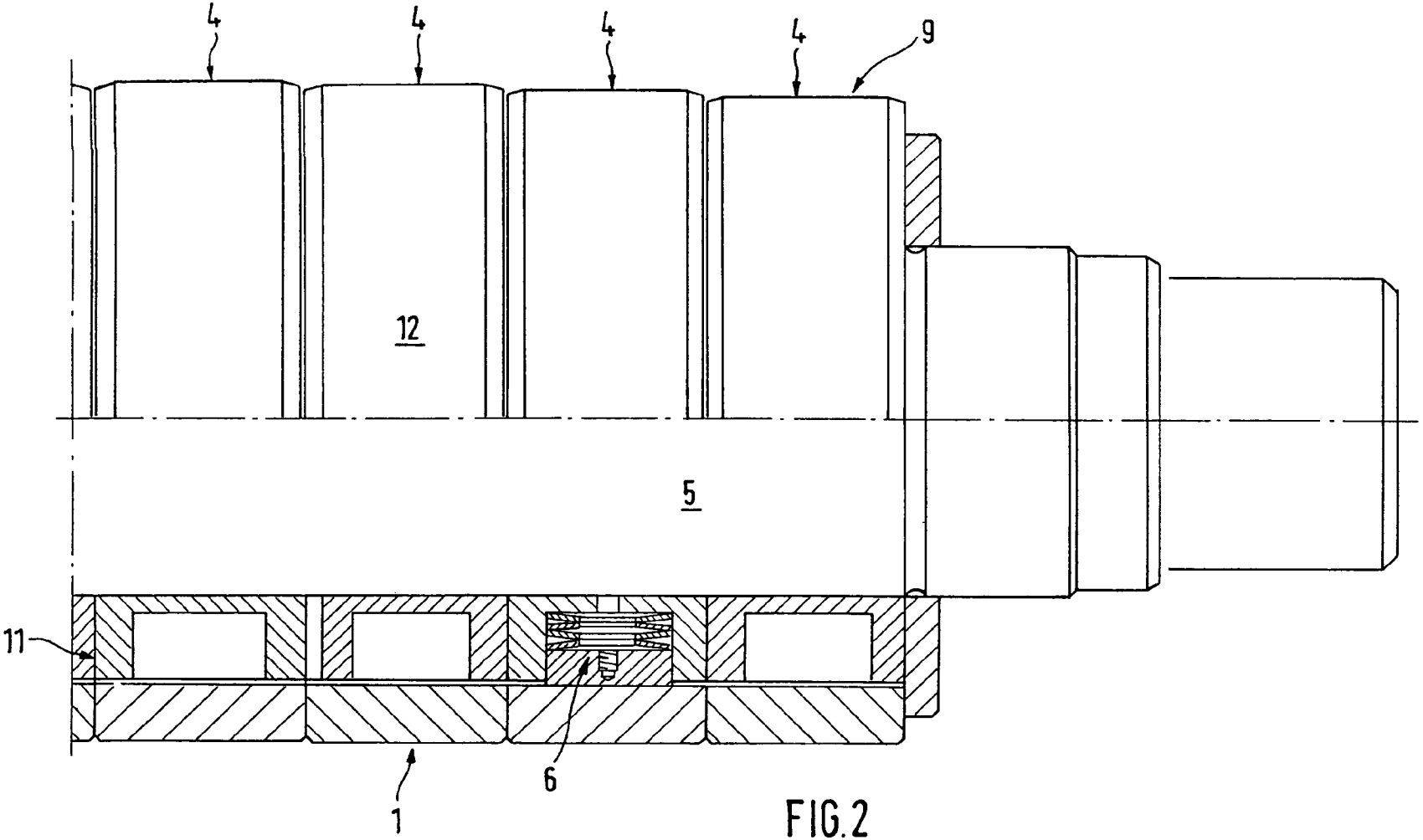

FIG. 2 shows a partial view of the troughed roller and below it the illustrated troughed roller in a partial section of a sectional plane parallel to the center line.

Taken together, the drawings of FIGS. 1, 1*a*, 1*b*, and FIG. 2 show that the bearing surface 3 of the troughed roller 1 is designed with a series of adjacent outer collars 4 of different diameters, which surround the core 5 of the troughed roller 1. The bearing surface 3 is uniformly supported by spring-tensioned support members 6 that project from this core 5 against the outer collars 4 from the inside. In this regard, the contact line 7 of the troughed roller 1 is acted on with uniform contact pressure along its entire longitudinal extent L.

The surfaces of the support members 6 in contact with the outer collars are curved to adapt them to the inner circumference of the outer collars 4. The back of each of these support members is lined with a set of disk springs 8 with predeterminable pretensioning. To achieve this, the support members 6 are mounted in the outer collars 4 with pretensionable spring force.

In addition, to compensate a load-related flexure of the troughed roller 1, which can be calculated or empirically determined, it is provided that the outside diameters of the outer collars 4 increase towards the middle of the troughed roller 1.

FIG. 1 shows a coil 2 with a large diameter and a coil 2 with a smaller diameter supported on two troughed rollers 1, 1', which are supported in fixed positions with their axes spaced a predetermined distance apart.

The drawing in FIG. 1*a* shows that the curvature of the surfaces of the coils 2, 2' varies considerably according to the size of their diameters. The surface of the already partially unwound coil 2' settles deeper between the troughed rollers 1, 1', while the surface of coil 2, which has a much larger diameter, has a shallower curvature between the two rollers 1, 1'. The contact points or contact lines are also shifted relative to each other.

FIG. 1*b* shows a side view of a troughed roller 1 with uniform load distribution over its length in the longitudinal direction with individual load forces acting on the adjoining outer collars 4. It is known from experience that these forces bring about limited flexure of the troughed roller 1, which, due to the weight, is stronger in the case of a full coil than in the case of an almost unwound coil. These differences can be compensated by the illustrated troughed rollers.

In the embodiment shown in FIG. 1*a*, the troughed roller 1' on the right side is designed with a motor drive and is illustrated accordingly.

FIG. 2 shows that adjoining outer rings 4 with a small difference in diameter fit next to the adjacent outer collars 4 with an oblique transition zone. Their bearing surfaces are also designed with a slight camber 9, which, however, does not exceed the magnitude of the difference in diameters.

The lower sectional drawing in FIG. 2 clearly shows the inner structure of the troughed roller 1 of the invention. The outer collars 4 of the troughed roller 1 enclose a solid central shaft 5. The central shaft 5 carries a middle collar 11 for holding support members 6 that can be pretensioned and an outer support collar 12 for holding the load.

In a surprisingly effective and uncomplicated way, the design of the troughed roller 1 in accordance with the invention ensures that the troughed roller can adapt even to a cambered coil, provides good support over the width of the coil, and prevents undesirable marks, especially in the case of thin strip.

LIST OF REFERENCE NUMBERS

1. troughed roller
2. coil
3. bearing surface
4. outer collar
5. core of the troughed roller
6. support member
7. contact line
8. disk spring
9. camber
10. trough-like depression
11. middle collar

The invention claimed is:

1. Coiler for rolled strip, which comprises at least one driven troughed roller (1) for turning a coil (2) during coiling or uncoiling of a rolled strip and a roller table upstream or downstream from the coiler, wherein the troughed roller (1) is designed with an elastically deformable outer collar (4), wherein the outer collar is uniformly supported by support members that are spring-tensioned from the inside by disk springs against the outer collar.

2. Coiler in accordance with claim 1, wherein the troughed roller (1) has a bearing surface (3) formed by a series of adjoining outer collars (4) of different diameters, which surround a core (5) of the troughed roller (1) so that they act on a contact surface (7) of the troughed roller (1) with the coil (2) over its entire longitudinal extent with uniform contact pressure.

3. Coiler in accordance with claim 2, wherein the support members (6) are designed with curved contact surfaces to adapt them to the inner circumference of the outer collars (4).

4. Coiler in accordance with claim 2, wherein the back of each support member (6) is lined with a set of disk springs (8) with predeterminable pretensioning.

5. Coiler in accordance with claim 2, wherein the support members (6) are mounted in the outer collars (4) with pretensionable spring force.

6. Coiler in accordance with claim 1, wherein to compensate a load-related flexure of the troughed roller (1), which can be calculated or empirically determined, the outside diameters of the outer collars (4) increase towards the middle of the troughed roller (1).

7. Coiler in accordance with claim 1, wherein adjoining outer collars (4) are provided with an oblique transition to the adjacent outer collars (4).

8. Coiler in accordance with claim 1, wherein the bearing surfaces of the outer collars (4) are designed with a slight camber (9), which, however, does not exceed the magnitude of the difference in diameters.

9. Coiler in accordance with claim 1, wherein two troughed rollers (1, 1') that can be arranged with a predeterminable axially parallel separation act together to support the load of the coil (2).

10. Coiler in accordance with claim 9, wherein at least one of these troughed rollers (1) has a rotational drive.

11. Coiler in accordance with claim 1, wherein the troughed roller (1) comprises a solid central shaft (5), a middle collar (11) on the shaft (5) for holding support members (6) that can be spring-tensioned, and an outer collar (4) with an outer support collar (12) for supporting the load.

12. Coiler in accordance with claim 1, wherein a contact surface (7), especially concave contact surface (7), that forms on a coil during the uncoiling can be automatically adapted to the usually cambered circumference of the coil (2) by means of the elastically yielding outer collars (4).

* * * * *